US005720541A

United States Patent [19]

Bayles

[11] Patent Number: 5,720,541

[45] Date of Patent: Feb. 24, 1998

[54] ILLUMINATING WRITING INSTRUMENT

[76] Inventor: Gary Bayles, 4103 Blossom Trail, Arlington, Tex. 76016

[21] Appl. No.: 597,958

[22] Filed: Feb. 7, 1996

[51] Int. Cl.[6] ..... B43K 29/10

[52] U.S. Cl. ..... 362/118; 362/32; 362/208

[58] Field of Search ..... 362/32, 118, 119, 362/120, 183, 208; 401/195

[56] References Cited

U.S. PATENT DOCUMENTS

| | | | |
|---|---|---|---|
| 3,963,914 | 6/1976 | Browning et al. | 362/118 |
| 5,131,775 | 7/1992 | Chen | 401/195 |
| 5,143,465 | 9/1992 | Hou | 401/195 |
| 5,275,497 | 1/1994 | Shiau | 401/195 |
| 5,388,038 | 2/1995 | Yang | 362/118 |
| 5,405,208 | 4/1995 | Hsieh | 401/195 |
| 5,413,429 | 5/1995 | Shiau | 401/195 |

FOREIGN PATENT DOCUMENTS

| | | | |
|---|---|---|---|
| 1118069 | 6/1968 | United Kingdom | 362/118 |

*Primary Examiner*—Y My Quach
*Attorney, Agent, or Firm*—Sidley & Austin

[57] ABSTRACT

An illuminating writing instrument for providing an illuminated writing surface and a method for its manufacture. The illuminating writing instrument includes a housing that defines an enclosure that holds the components of the illuminating instrument. The housing has an end that supports a writing point and an end that supports an upper portion having a transparent window portion that allows light to pass therethrough. The housing also encloses an electrical circuit that includes a power source, a switch, and a light source such that when the switch is activated, the light source produces illumination. The upper portion of the housing also includes a reflector that reflects light from the light source through the transparent window portion to illuminate a writing surface. The illuminating writing instrument can also include at least one optic fiber that extends from an area adjacent the light source, along a portion of the length of the housing, and to a location adjacent the writing point to illuminate a writing surface. The illuminating writing instrument can also include a replaceable writing means, a replaceable power source, and a replaceable light source. The illuminating writing instrument can also include a rechargeable power source and a device to afford recharging to the rechargeable power source.

19 Claims, 6 Drawing Sheets

FIG.1

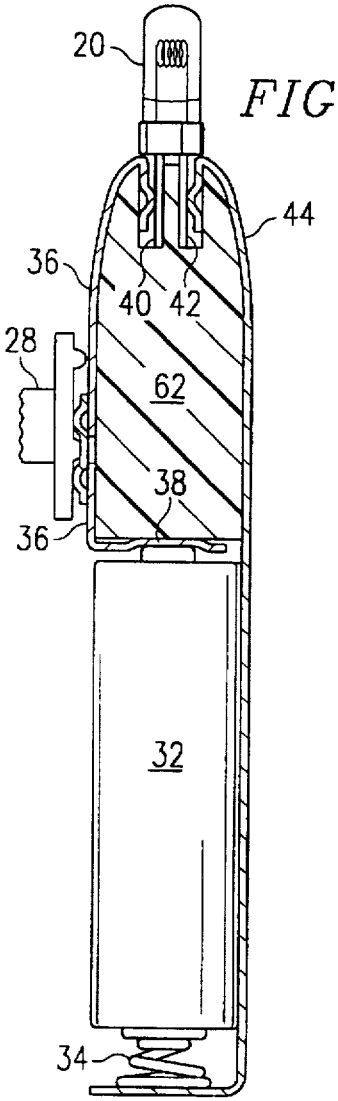
FIG. 5
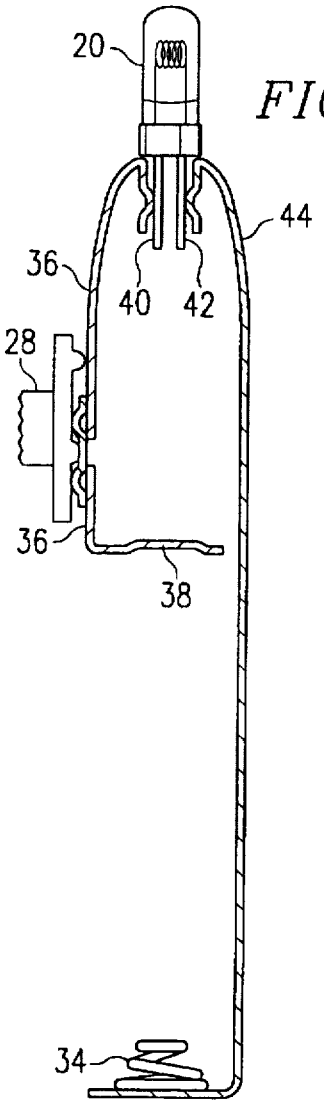
FIG. 6
FIG. 7
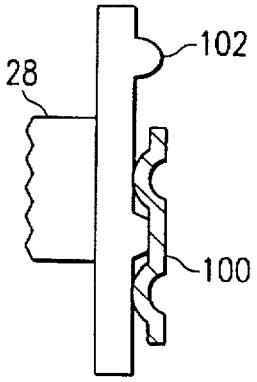
FIG. 8
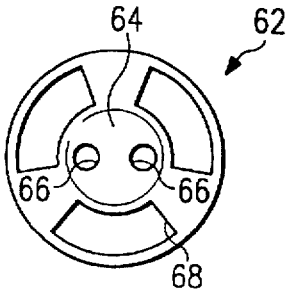

ILLUMINATING WRITING INSTRUMENT

TECHNICAL FIELD OF THE INVENTION

The present invention generally relates to writing instruments that can emit light to facilitate writing in low ambient light environments.

BACKGROUND OF THE INVENTION

Conventional writing instruments such as pens, pencils and other hand-held writing instruments in general are necessary items for recording a person's thoughts or ideas. It is better for a writer to see the paper or surface on which the writing is recorded. A well lit writing environment is often taken for granted, except when the immediate writing area cannot be observed because of low ambient light. In the situation where either no light or insufficient light is available, conventional writing instruments are less effective.

Writing instruments which are capable of illuminating the writing area were developed in an attempt to address the difficulty of writing in low ambient light environments. These illuminated writing instruments include the writing instruments described in U.S. Pat. No. 5,131,775, 5,143,465, 5,275,497, 5,388,038, and 5,405,208.

These prior art illuminating writing instruments have the limitation of emitting light from only one area of the writing instrument that is near the writing portion of the writing instrument. The efficient and effective emission of light in these prior art devices is inhibited because of the inherent interference with light emission caused by the writer's hand around the grasping portion of the writing instrument. Further, the area of the writing surface that is illuminated by these prior art devices is insufficient because the light is emitted from only a single light source that has a rather close proximity to the writing surface. As can be seen from the foregoing, a need exists for a writing instrument that emits light further away from the writing surface to illuminate a larger area of the writing surface, and as an alternative, a writing instrument with such a feature that can also emit light in the immediate writing area near the writing point.

SUMMARY OF TEE INVENTION

The illuminating writing instrument of the present invention overcomes the problems and shortcoming of the prior art. In a broad aspect of the present invention, the writing instrument includes a housing having a grasping portion, a writing end, and an upper portion above the grasping portion. The writing end has a writing point. The upper portion has a transparent window portion through which light from a light source in the upper portion is transmitted. A reflector is fixed within the upper portion in the path of the light emitted from the light source to reflect light through the transparent window portion and toward the writing point. In this manner, the emission of light takes place further away from the writing area, thereby resulting in a broader total area of illumination.

In another aspect of the present invention, the illuminating writing instrument includes a housing that includes an electric circuit for light generation and at least one optic fiber for carrying light emanating from the light source to exit adjacent the writing point. The circuit includes a power source, such as a battery, in a power source compartment connected through a switching means to a light source. The light source is activated by the switching means which is manually operable.

In a preferred embodiment of the present invention, the illuminating writing instrument additionally includes several optical fibers that transmit light from the light source in the upper portion of the writing instrument to the writing portion of the pen so as to illuminate the writing surface immediately adjacent the writing portion. With this arrangement, light is emitted from the transparent window portion of the upper portion and is also emitted from the writing portion. Thus, the present invention may be useful to any person writing in a low ambient light environment including, for example, the following: people in a meeting that requires dim light to use a projector; occupants of aircraft cockpits at night and other similar situations where cathode ray tubes are used; professionals who work in dim or dark environments such as police officers, nurses, and security guards; and, passengers on planes, subway trains, buses, etc.

In another preferred embodiment of the present invention, the light source, power source, and writing means of the illuminating writing instrument are replaceable. In another preferred embodiment of the present invention, the power source of the illuminating writing instrument is rechargeable.

BRIEF DESCRIPTION OF THE DRAWINGS

FIG. 5 is a view of the circuit of an illuminating writing instrument in accordance with the present invention.

FIG. 6 is a view of the circuit of an illuminating writing instrument in accordance with the present invention.

FIG. 7 is a view of the switch of an illuminating writing instrument in accordance with the present invention.

FIG. 8 is a view of an insert of an illuminating writing instrument in accordance with the present invention.

DETAILED DESCRIPTION

Conventional writing instruments cannot be used effectively in low ambient light environments without the assistance of an additional source of illumination. The novel illuminating writing instrument of the present invention provides illumination so that the illuminating writing instrument may be used to write clearly and easily in low ambient light conditions without the assistance of an external source of illumination, such as an overhead light or lamp.

Figure 4:
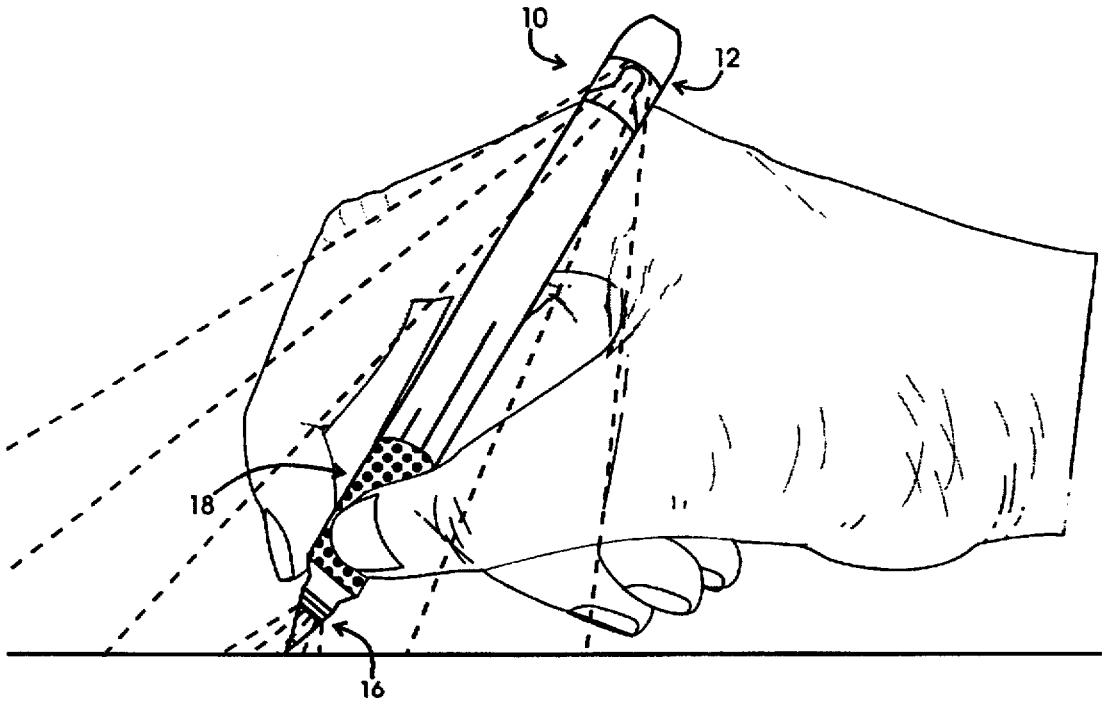
FIG. 4 is a view of an illuminating writing instrument in accordance with the present invention observed in use.

The present invention is capable of providing illumination across a wider area of the writing surface than prior art devices because a light source is provided further away from the writing surface. As shown in FIG. 4, the illuminating writing instrument of the present invention, generally denoted as 10, is capable of emitting light from both an upper portion 12 that is distanced from the writing surface and a writing portion 16 that is near the writing surface. Thus, illuminating writing instrument 10 is capable of emitting light from two areas of the writing instrument (one area away from the writing surface and one close to the writing surface), whereas, prior art writing instruments emit light from only a single area of the writing instrument located near the writing surface. In addition, the present invention is highly efficient because it emits light from two different sources, yet uses only one light source in doing so.

As shown in FIG. 4, illuminating writing instrument 10 provides superior illumination to a writing surface by emitting light from both writing portion 16 and upper portion 12. The writer depicted in FIG. 4 is grasping the writing instrument on grasping portion 18 such that light emitted from upper portion 12 is emitted above grasping portion 18 and is directed toward the writing surface and light emitted from writing end 16 is emitted below grasping portion 18.

As shown in FIG. 4, light emitted from illuminating writing instrument 10 is more focused downward toward the writing surface than is light emitted from prior art devices. Prior art devices have a history of emitting light laterally instead of directing the light toward the writing surface. As such, the present invention reduces the amount of lateral light emission which may disturb other people in the vicinity. Thus, illuminating writing instrument 10 provides superior illumination without creating a lateral light source that could create unnecessary and unwanted illumination.

The present invention is not limited to ink as the writing means, as are the illuminating pens of the prior art. The improved and increased illumination provided by the present invention allows for the use of ink or pencil lead in a low ambient light environment without the assistance of an additional light source. The illuminating writing instrument of the present invention may also be used as a conventional writing instrument without the light illumination feature.

Figure 1:
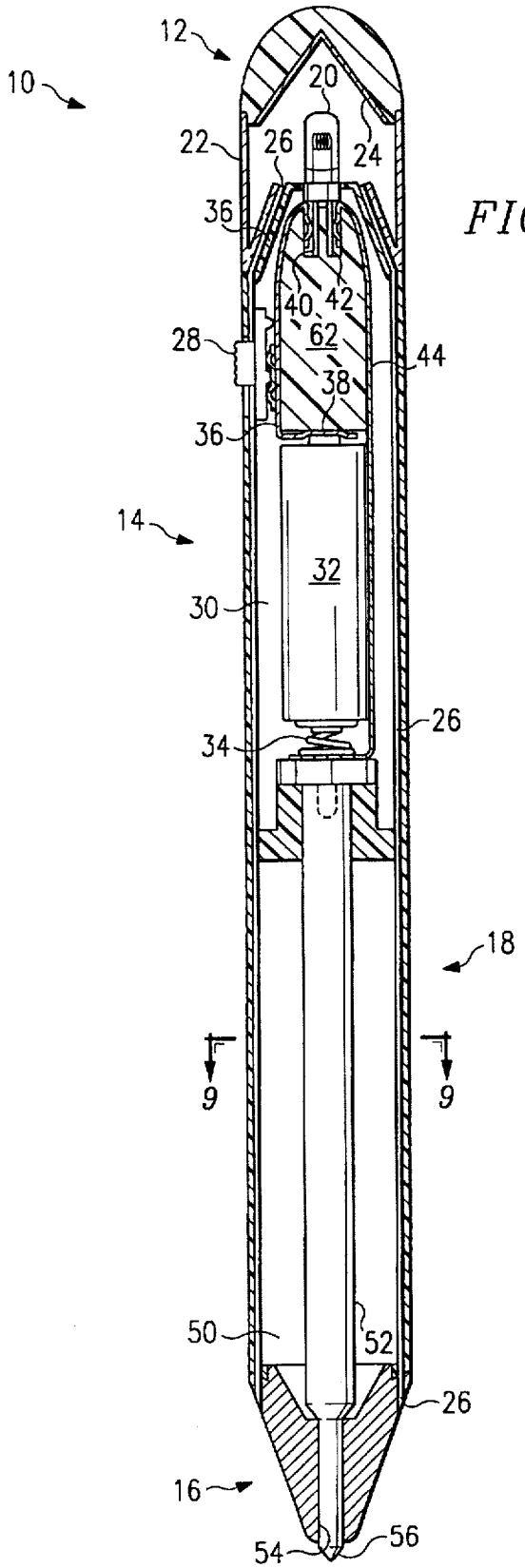
FIG. 1 is a longitudinal cross-sectional view of an illuminating writing instrument in accordance with the present invention.

As shown in FIG. 1, illuminating writing instrument 10 includes housing 14, upper portion 12, and writing portion 16. Housing 14 provides a grasping portion 18. Grasping portion 18 is defined by that portion of housing 14 that is grasped by a writer using illuminating writing instrument 10 to write. Grasping portion 18 is generally disposed in about the lower ⅓ to about the lower ¼ of a normal sized pen of about five to about six inches. As such, grasping portion 18 is preferably from about 1 to about 1½ inches in length above the writing portion 16.

Disposed within housing 14 are power source compartment 30 and writing means compartment 50. Power source compartment 30 is disposed between upper portion 12 and writing means compartment 50. Writing means compartment 50 is disposed between power source compartment 30 and writing portion 16. As shown in FIG. 1, writing means compartment 50 contains writing means 52. Writing means 52 has a writing point 56 that extends through writing point channel 54 of writing portion 16. Writing point 56 includes any writing point capable of marking a writing surface including a ball point, a felt tip, and a lead. Writing means 52 includes an ink cartridge or a lead. The preferred writing means 52 is an ink cartridge having as the preferred writing point 56 a ball point.

Upper portion 12 includes a light source 20 and a transparent window portion 22. Light source 20 may include, as the preferred light source, a halogen bulb, as well as any other source of illumination; including, but not limited to, light emitting diodes, sources of infrared light, or any other small light source. Light source 20 includes contacts 40 and 42. Light source 20 is preferably surrounded by transparent window portion 22. Transparent window portion 22 may include any transparent material, such as plastic, glass and even air. Transparent window portion 22 is disposed in upper portion 12 and therefore is located above grasping portion 18 to provide for the emission of light above grasping portion 18.

Upper portion 12 may further include a reflector 24 disposed so as to reflect light emitted from light source 20 through transparent window portion 22 toward the writing surface. Reflector 24 is disposed within upper portion 12 such that light source 20 is disposed between power source compartment 30 and reflector 24. Reflector 24 is preferably cone shaped having a narrow end, a broad open end, an outside surface, and an inside surface. The preferred reflector 24 has reflective material disposed on its inside surface. Preferred reflector 24 is disposed such that light emitted from light source 20 is reflected off its inside surface, through transparent window portion 22, and toward the writing surface.

Writing portion 16 includes a writing point channel 54 through which writing point 56 can extend. Writing portion 16 also illuminates the writing surface with the ends of optic fibers 26. Optic fibers 26 transfer light from light source 20 in upper portion 12 along the length of housing 14 to writing portion 16.

Figure 2:
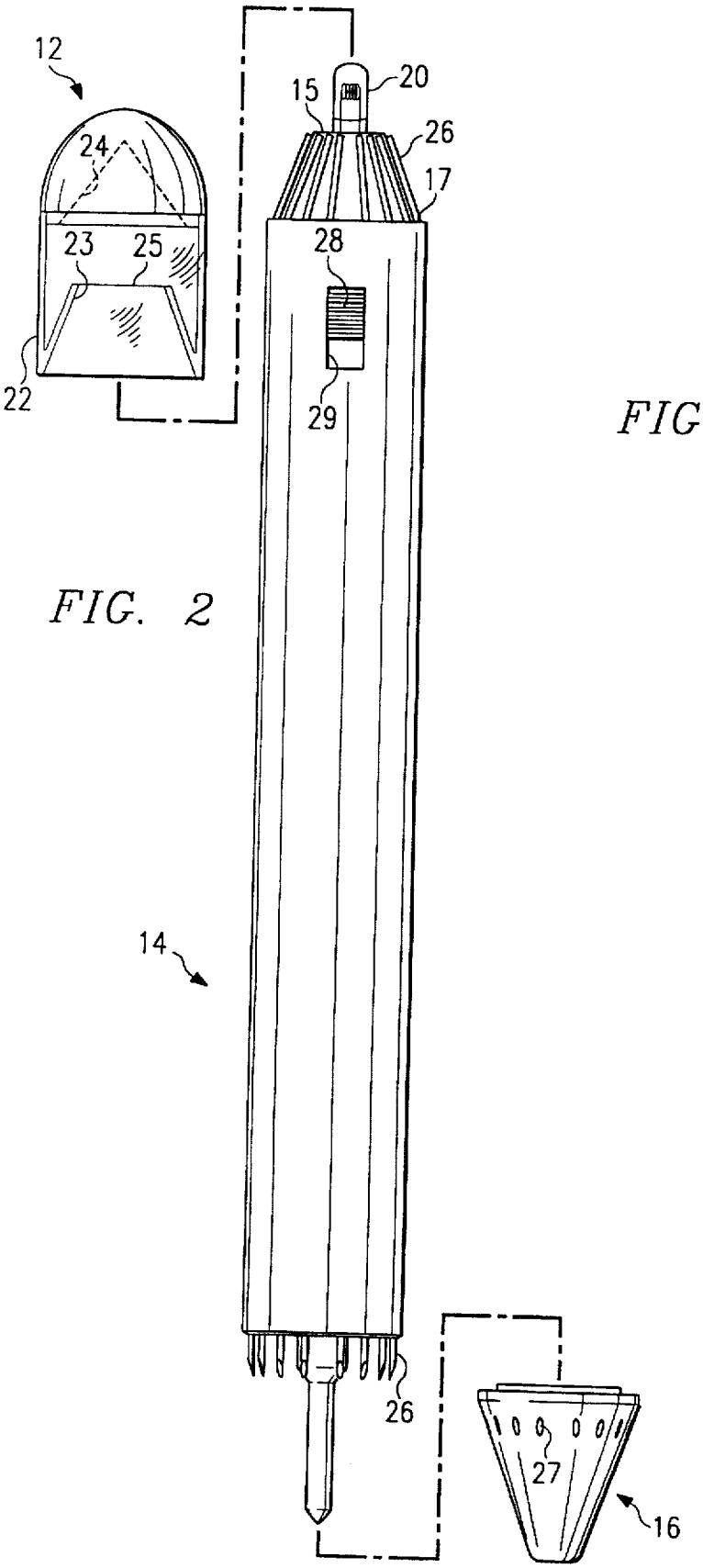
FIG. 2 is an exploded view of the outside body parts of an illuminating writing instrument in accordance with the present invention.

As shown in FIG. 2, the outside body parts of illuminating writing instrument 10 include upper portion 12, housing 14, and writing portion 16. Transparent window portion 22 includes cone 23 that has aperture 25. Cone 23 serves to bend optic fibers 26 toward light source 20. Aperture 25 of cone 23 receives light source 20.

Optic fibers 26 are disposed along the length of housing 14 and transmit light from light source 20 in upper portion 12 to writing portion 16. A preferred embodiment comprises about 20 optic fibers 26. Optic fibers 26 include any light transmitter. Each optic fiber has a first end and a second end. The first end of the optic fiber is optically connected to upper portion 12. An internal edge of cone 23 of transparent window portion 22 positions the first end of optic fiber 26 downward to direct that end toward the light source 20. Thus, a plurality of optic fibers 26 would be positioned as shown in FIG. 2. Housing 14 includes aperture 17 that receives optic fibers 26. Housing 14 also includes aperture 15 that allows light source 20 to extend therethrough.

Optic fibers 26 are also optically connected to writing portion 16 such that light can be emitted therefrom. As shown in FIG. 2, writing portion 16 includes several apertures 27 that allow the second end of the optic fibers 26 to extend therethrough. Apertures 27 secure optic fibers 26 within writing portion 16 so as to surround writing point 56 and provide uniform illumination to the writing surface. Each optic fiber 26 has the ability to allow light emitted from light source 20 to travel to and exit from writing portion 16 to provide illumination to the writing surface.

Figure 3:
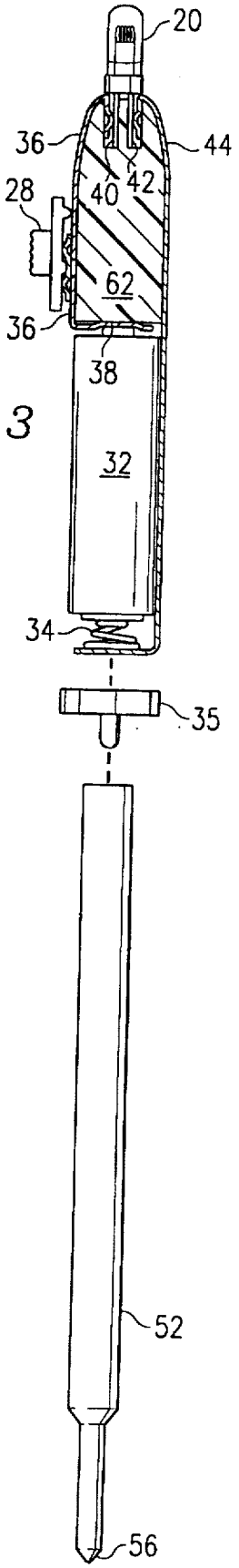
FIG. 3 is a view of the internal components of an illuminating writing instrument in accordance with the present invention.

As shown in FIG. 3, the inside components of illuminating writing instrument 10 include light source 20 having contacts 40 and 42, conductors 36 and 44, switch 28, anode plate 38, insert 62, power source 32, a first coiled spring 34, insert 35, and writing means 52 having writing point 56. In alternative embodiments, a coiled spring (not shown) may be located at other locations in the writing instrument such as being disposed between the conductor 44 and insert 35 or between insert 35 and the writing means 52.

Power source 32 includes any power source, including a rechargeable power source, that is capable of providing a current of electricity through the circuit of the present invention. The preferred power source 32 is a battery. As shown in FIG. 5, the power source 32 is disposed within the power source compartment 30. The power source 32 is electrically connected to the anode plate 38 that is disposed in the upper portion of the power source compartment 30. The anode plate 38 is electrically connected to conductor 36 that electrically connects power source 32 to contact 40 of light source 20 through switch 28. The power source 32 is also electrically connected to the first coiled spring 34 disposed in the lower portion of the power source compartment 30. The first coiled spring 34 is electrically connected to conductor 44 that is electrically connected to contact 42 of light source 20. Thus, the circuit of illuminating writing instrument 10 extends from the positive terminal of power source 32, to anode plate 38, to conductor 36, through switch 28, to contact 40, through light source 20, to contact 42, to conductor 44, to coiled spring 34, and to the negative terminal of power source 32.

FIG. 6 depicts the electrical circuit depicted in FIG. 5 with the internal insert 62 and power source 32 removed from view. Anode plate 38, conductor 36, and conductor 44 are all preferably molded to insert 62. Conductors 36 and 44 are preferably rigid copper bands.

The circuit of the present invention includes switch 28. Switch 28 includes any switch or switching means that provides means to turn on and off light source 20. As shown in FIG. 7, switch 28 includes a plastic bump 102 to hold switch 28 in the "off" position and recesses 100 that are conductive and hold switch 28 in the "on" position. As shown in FIG. 2, housing 14 includes aperture 29 in which switch 28 is disposed.

As shown in FIG. 8, insert 62 includes seat 64, apertures 66, and apertures 68. Seat 64 supports light source 20. Insert 62 has a first aperture 66 and a second aperture 66. Insert 66 optionally provides apertures 68. Optional apertures 68 provide for a reduction in the amount of material needed to comprise insert 62 to minimize the weight of illuminating writing instrument 10. As shown in FIG. 5, first aperture 66 receives contact 40 of light source 20 and conductor 36. The second aperture 66 receives contact 42 of light source 20 and conductor 44. Thus, apertures 66 of insert 62 position light source 20 within illuminating writing instrument 10. Insert 62 can have any shape that facilitates the positioning of any of the components of illuminating writing instrument 10 including anode plate 38, conductor 36, contact 40, light source 20, contact 42, conductor 44, switch 28, and optic fibers 26.

Figure 9:
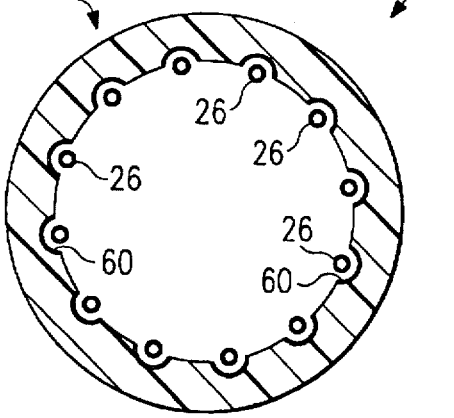
FIG. 9 is a latitudinal cross-sectional view of the illuminating writing instrument in accordance with the present invention depicted in FIG. 1 taken along line 9—9 of FIG. 1.

FIG. 9 depicts a latitudinal cross-sectional view of illuminating writing instrument 10 having several light transmitter channels 60 in housing 14 containing optic fibers 26. Light transmitter channels 60 can serve as optic fiber channels that secure optic fibers 26 to housing 14 and uniformly distribute optic fibers 26 to provide uniform lighting to the writing surface surrounding writing portion 16. An especially preferred illuminating writing instrument 10 includes about 20 optic fibers 26 extending from upper portion 12 to writing portion 16 through channels 60.

Figure 10:
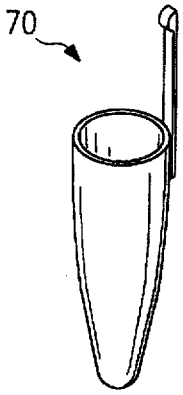
FIG. 10 is a view of a cap of an illuminating writing instrument in accordance with the present invention.

As shown in FIG. 10, illuminating writing instrument 10 may include a cap 70. A preferred upper portion 12 further includes a cap capable of also being used to cover writing point 56. Upper portion 12 may further include a cap holder or is formed so as to hold a cap that can cover writing point 56.

Figure 11:
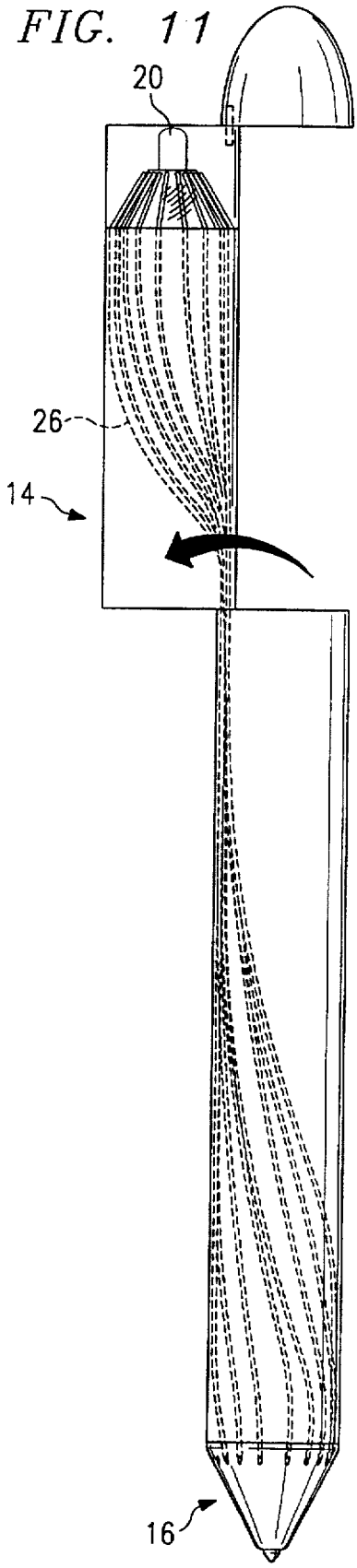
FIG. 11 is a view of an illuminating writing instrument in accordance with the present invention that allows for replacement of the light source, the power source, and the writing means and that allows the illuminating writing instrument to be used as a flashlight.

As shown in FIG. 11, illuminating writing instrument 10 can twist open so as to allow for easy replacement of light source 20, power source 32, and writing means 52. Thus, illuminating writing instrument may include a replaceable light source 20, a replaceable power source 32, and a replaceable writing means 52. Moreover, upper portion 12 can be adjusted to allow writing instrument 10 to function as a flashlight.

Figure 12:
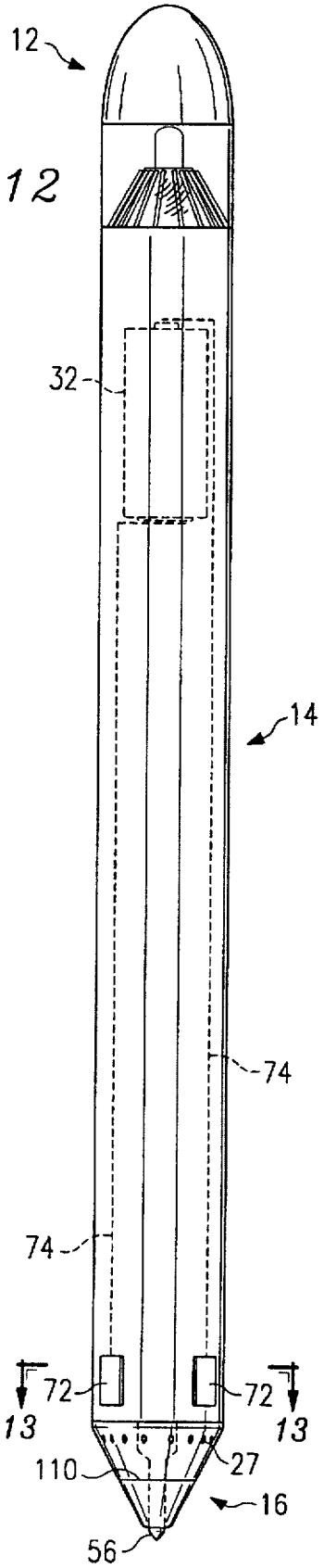
FIG. 12 is a view of a rechargeable illuminating writing instrument in accordance with the present invention that allows a rechargeable power source therein to be recharged and that also allows for replacing or refilling the writing means.

As shown in FIG. 12, illuminating writing instrument 10 may additionally include a rechargeable power source 32. Rechargeable power source 32 is electrically connected to contacts 72 by conductors 74. As also shown in FIG. 12, illuminating writing instrument 10 may include a threaded seam 110 in writing portion 16 that can be removed to allow for replacement of writing means 52. The replaceable writing means 52 can also be in contact with a coiled spring (not shown) that is disposed between insert 35 and replaceable writing means 52.

Figure 13:
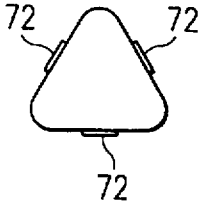
FIG. 13 is a latitudinal cross-sectional view of the illuminating writing instrument in accordance with the present invention depicted in FIG. 12 taken along line 13—13 of FIG. 12 that depicts the contacts of the rechargeable illuminating writing instrument shown in FIG. 12.
Figure 14:
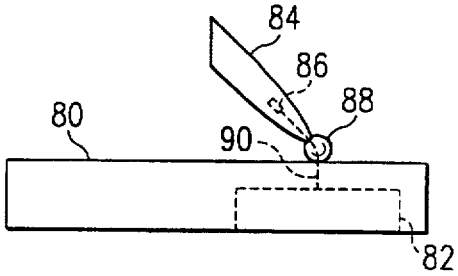
FIG. 14 is a view of an executive desk top writing instrument holder that recharges the rechargeable illuminating writing instrument shown in FIG. 12.

Preferably, as shown in FIG. 13, three contacts 72 are disposed on a triangularly shaped housing 14. Contacts 72 are preferably point contacts but can be configured as conductive bands surrounding the housing 14. As shown in FIG. 14, the rechargeable illuminating writing instrument holder includes base 80, self sensing charger 82, writing instrument holder 84, contacts 86, swivel 88 and conductors 90. Writing instrument holder 84 positions contacts 72 with respect to contacts 86 when illuminating writing instrument 10 is received in holder 84. Contacts 86 are electrically connected to self sensing charger 82 by conductors 90. Self-sensing charger 82 senses and charges rechargeable power source 32 if necessary.

Housing 14 may further include a retracting means that allows for writing point 56 of writing means 52 to extend out of and retract into writing portion 16. This retracting means may be operably coupled to switch 28 such that operation of the retracting means serves as switch 28 or serves to operate switch 28. The retracting means includes all conventional retracting or twisting means known to afford extension and retraction of writing point 56.

This invention also includes a process of manufacturing illuminating writing instrument 10. Illuminating writing instrument 10 is preferably manufactured of conventional writing instrument material, including but not limited to metal, plastic, or other suitable material. A method of constructing illuminating writing instrument 10 includes the steps of forming a housing to support a writing point and to enclose a power source and a light source, forming an electrical circuit with a switch and the power source and the light source, forming in the housing, in a location generally spaced from the writing point so that a portion of the housing therebetween can be grasped, a transparent window portion that allows light to be transmitted therethrough the housing, where the light source is located with respect to the housing that allows light to be transmitted therethrough so that light is transmitted to an area adjacent the writing point. The method preferably further includes enclosing a reflector with the housing that allows light to be transmitted through the region that allows light to be transmitted therethrough the housing and enclosing at least one optic fiber within the housing that allows light to be transmitted to an area adjacent the writing point. The method also preferably includes enclosing a plurality of optic fibers within said housing that allow light to be transmitted to an area adjacent the writing point.

Thus, the illuminating writing instrument of the present invention is capable of emitting light from both an upper portion and writing portion. The additional emitting area provides a wider illuminated writing surface with more directed light than the prior art.

The above description and drawings illustrate preferred embodiments of the present invention and are not limitative of the scope of the present invention.

I claim:

1. An illuminating writing instrument comprising:

an upper portion having a transparent window portion disposed therein;

a writing portion supporting a writing point;

a housing having a grasping portion disposed between said upper portion and said writing portion;

an electrical circuit disposed in said housing including a power source coupled to a switch, said switch coupled to a light source that is coupled back to said power source; and, a reflector disposed within said upper portion so that light from said light source is reflected off said reflector and through said transparent window portion to a region outside said upper portion above the grasping position toward a writing surface to illuminate the writing surface.

2. The illuminating writing instrument of claim 1 wherein said housing further comprises a writing means compartment disposed within said housing and wherein said writing portion further comprises a writing point channel.

3. The illuminating writing instrument of claim 2 further comprising a writing means having said writing point disposed within said writing means compartment such that said writing point extends through said writing point channel of said writing portion.

4. The illuminating writing instrument of claim 1 wherein said housing further comprises a power source compartment.

5. The illuminating writing instrument of claim 4 wherein said power source is a battery disposed within said power source compartment and is electrically connected to said circuit.

6. The illuminating writing instrument of claim 1 further comprising at least one optic fiber extending from an area adjacent said light source to a location adjacent said writing point to illuminate said writing surface.

7. The illuminating writing instrument of claim 6 further comprising a plurality of optic fibers and a plurality of channels in said housing that secure and uniformly space said optic fibers along a portion of a length of said housing.

8. The illuminating writing instrument of claim 7 wherein said transparent window portion positions an end of one of said plurality of optic fibers toward said light source.

9. An illuminating writing instrument, comprising:

a housing having a lower end and an upper end, said housing having a light source disposed therein;

a writing portion connected to said lower end of said housing, said writing portion supporting a writing point;

a power source compartment disposed in said housing, said power source compartment having terminals coupled through a switch to said light source wherein said light source is coupled back to a power source; and, at least one optic fiber disposed along a portion of a length of said housing transmitting light from said light source to said writing point.

10. The illuminating writing instrument of claim 9 further comprising an upper portion connected to said upper end of said housing, said upper portion having a transparent window portion disposed therein so that light that emanates from said light source through said transparent window portion emanates independently from said light that emanates from said optic fiber.

11. The illuminating writing instrument of claim 9 wherein said transparent window portion positions said optic fiber toward said light source.

12. The illuminating writing instrument of claim 9 further comprising a battery as said power source disposed within said power source compartment.

13. The illuminating writing instrument of claim 9 wherein said housing further comprises a writing means compartment.

14. The illuminating writing instrument of claim 13 further comprising channels along the length of said housing and comprising about 20 optic fibers, each fiber disposed in a respective channel.

15. The illuminating writing instrument of claim 13 further comprising:

an insert disposed between said writing means compartment and said power source compartment; and, a threaded seam in said writing portion that allows said writing means to be replaceably removed from said writing means compartment.

16. The illuminating writing instrument of claim 15 further comprising:

contacts disposed on said housing connected to a rechargeable power source disposed in said power source compartment through conductors.

17. A method of constructing a writing instrument for illuminating a writing surface, comprising the steps of:

forming a housing to support a writing point and to enclose a power source and a light source;

forming an electrical circuit with a switch and said power source and said light source;

forming in said housing, in a location generally spaced from the writing point so that a portion of the housing therebetween can be grasped, a transparent window portion that allows light to be transmitted therethrough the housing;

placing a reflector in an upper portion of said housing so that light from said light source is reflected off said reflector and through said transparent window portion to a region outside said upper portion above said grasping portion toward the writing surface to illuminate the writing surface.

18. The method of claim 17 further comprising enclosing at least one optic fiber within said housing that allows light to be transmitted to an area adjacent the writing point.

19. The method of claim 18 further comprising enclosing a plurality of optic fibers within said housing that allow light to be transmitted to said area adjacent the writing point.

* * * * *

UNITED STATES PATENT AND TRADEMARK OFFICE

CERTIFICATE OF CORRECTION

PATENT NO. : 5,720,541
DATED : February 24, 1998
INVENTOR(S) : Gary Bayles

It is certified that error appears in the above-identified patent and that said Letters Patent is hereby corrected as shown below:

The title page, showing an illustrative figure, should be deleted and substitute therefor the attached title page.

Signed and Sealed this

First Day of September, 1998

*Attest:*

*Attesting Officer*

BRUCE LEHMAN

*Commissioner of Patents and Trademarks*

United States Patent [19]

Bayles

[11] Patent Number: 5,720,541

[45] Date of Patent: Feb. 24, 1998

[54] ILLUMINATING WRITING INSTRUMENT

[76] Inventor: Gary Bayles, 4103 Blossom Trail, Arlington, Tex. 76016

[21] Appl. No.: 597,958

[22] Filed: Feb. 7, 1996

[51] Int. Cl.[6] ..... B43K 29/10

[52] U.S. Cl. ..... 362/118; 362/32; 362/208

[58] Field of Search ..... 362/32, 118, 119, 362/120, 183, 208; 401/195

[56] References Cited

U.S. PATENT DOCUMENTS

| | | | |
|---|---|---|---|
| 3,963,914 | 6/1976 | Browning et al. | 362/118 |
| 5,131,775 | 7/1992 | Chen | 401/195 |
| 5,143,465 | 9/1992 | Hou | 401/195 |
| 5,275,497 | 1/1994 | Shiau | 401/195 |
| 5,388,038 | 2/1995 | Yang | 362/118 |
| 5,405,208 | 4/1995 | Hsieh | 401/195 |
| 5,413,429 | 5/1995 | Shiau | 401/195 |

FOREIGN PATENT DOCUMENTS

| | | | |
|---|---|---|---|
| 1118069 | 6/1968 | United Kingdom | 362/118 |

*Primary Examiner*—Y My Quach
*Attorney, Agent, or Firm*—Sidley & Austin

[57] ABSTRACT

An illuminating writing instrument for providing an illuminated writing surface and a method for its manufacture. The illuminating writing instrument includes a housing that defines an enclosure that holds the components of the illuminating instrument. The housing has an end that supports a writing point and an end that supports an upper portion having a transparent window portion that allows light to pass therethrough. The housing also encloses an electrical circuit that includes a power source, a switch, and a light source such that when the switch is activated, the light source produces illumination. The upper portion of the housing also includes a reflector that reflects light from the light source through the transparent window portion to illuminate a writing surface. The illuminating writing instrument can also include at least one optic fiber that extends from an area adjacent the light source, along a portion of the length of the housing, and to a location adjacent the writing point to illuminate a writing surface. The illuminating writing instrument can also include a replaceable writing means, a replaceable power source, and a replaceable light source. The illuminating writing instrument can also include a rechargeable power source and a device to afford recharging to the rechargeable power source.

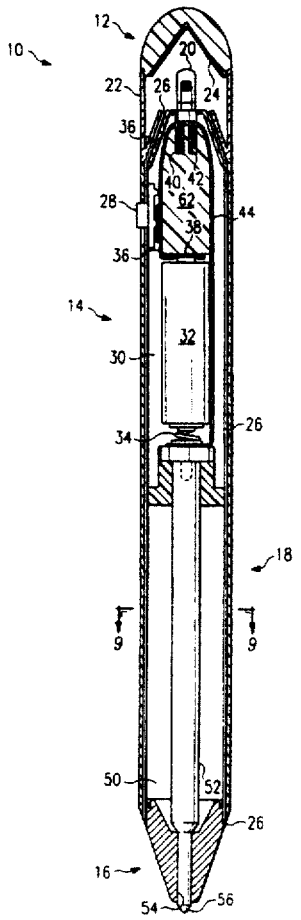

19 Claims, 6 Drawing Sheets